US007389715B1

(12) United States Patent
Lin

(10) Patent No.: US 7,389,715 B1
(45) Date of Patent: Jun. 24, 2008

(54) PLIERS-TYPE HAND TOOL

(76) Inventor: Ming-Shuan Lin, No. 29-2, Sec. 1, Tafeng Rd. Tantzu Hsiang, Taichung Hsien (TW)

( * ) Notice: Subject to any disclaimer, the term of this patent is extended or adjusted under 35 U.S.C. 154(b) by 0 days.

(21) Appl. No.: 11/784,905

(22) Filed: Apr. 9, 2007

(51) Int. Cl.
*B25B 7/06* (2006.01)

(52) U.S. Cl. ..... 81/416

(58) Field of Classification Search ..... 81/416; 403/156; 16/340
See application file for complete search history.

(56) References Cited

U.S. PATENT DOCUMENTS 540,764 A * 6/1895 Menzo ..... 403/150
850,319 A * 4/1907 Robinson ..... 7/130
2,088,224 A * 7/1937 Aiken ..... 81/416
2,704,399 A * 3/1955 Melcher ..... 30/266
2,939,215 A * 6/1960 Putsch et al. ..... 30/266
3,833,953 A * 9/1974 Fisher et al. ..... 7/133
4,478,532 A * 10/1984 Puro ..... 403/157
4,843,927 A * 7/1989 Gulistan ..... 81/416
4,882,959 A * 11/1989 Sakai ..... 81/416
5,033,140 A * 7/1991 Chen et al. ..... 7/127
5,575,029 A * 11/1996 Simpson ..... 7/137

* cited by examiner

*Primary Examiner*—David B Thomas
(74) *Attorney, Agent, or Firm*—David N. Lathrop, Esq.; Gallagher & Lathrop

(57) ABSTRACT

A pliers-type hand tool includes first and second arms, a pivot joint, and a locking member. The first arm is formed with a threaded blind hole. The second arm is formed with a through hole. The pivot joint extends through the through-hole in the second arm and threadedly engages the threaded blind hole in the first arm, and is formed with a threaded through-hole. The locking member threadedly engages and extends through the threaded through hole in the pivot joint, and abuts against the first arm.

9 Claims, 3 Drawing Sheets

PLIERS-TYPE HAND TOOL

BACKGROUND OF THE INVENTION

1. Field of the Invention

The invention relates to a tool, more particularly to a pliers-type hand tool.

2. Description of the Related Art

A conventional pair of pliers includes first and second arms. Each of the first and second arms includes a handle, a jaw, and an intermediate portion that interconnects the handle and the jaw thereof. The intermediate portions of the first and second arms are pivotally connected together by means of a rivet.

The aforementioned conventional pair of pliers has the following disadvantages:

1. Since the rivet is installed by a riveting machine, the imprecision inherent in riveting machines is such that the rivet may be too loose or too tight, thereby affecting adversely operation of the conventional pair of pliers.

2. After the installation of the rivet, the intermediate portions of the first and second arms need to be smoothened, thus increasing manufacturing costs.

3. Re-tightening of the rivet when the rivet becomes loose after a certain period of use of the conventional pliers is not possible.

SUMMARY OF THE INVENTION

Therefore, the main object of the present invention is to provide a pliers-type hand tool that can overcome the aforesaid drawbacks of the prior art.

According to the present invention, a pliers-type hand tool comprises first and second arms, a pivot joint, and a locking member. The first arm includes a handle, a jaw, and an intermediate portion that interconnects the handle and the jaw thereof and that is formed with a threaded blind hole. The second arm includes a handle, a jaw, and an intermediate portion that interconnects the handle and the jaw thereof and that is formed with a through-hole. The pivot joint interconnects the intermediate portions of the first and second arms, and permits relative rotation of the first and second arms about a pivot axis. The pivot joint includes a head portion, and a shank portion that extends along the pivot axis from the head portion and through the through-hole in the intermediate portion of the second arm, and that threadedly engages the threaded blind hole in the intermediate portion of the first arm. The pivot joint is formed with a threaded through-hole that extends along the pivot axis and through the head and shank portions thereof. The locking member serves to tighten engagement between the shank portion of the pivot joint and the threaded blind hole. In particular, the locking member threadedly engages and extends through the threaded through-hole in the pivot joint, and abuts against the intermediate portion of the first arm.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
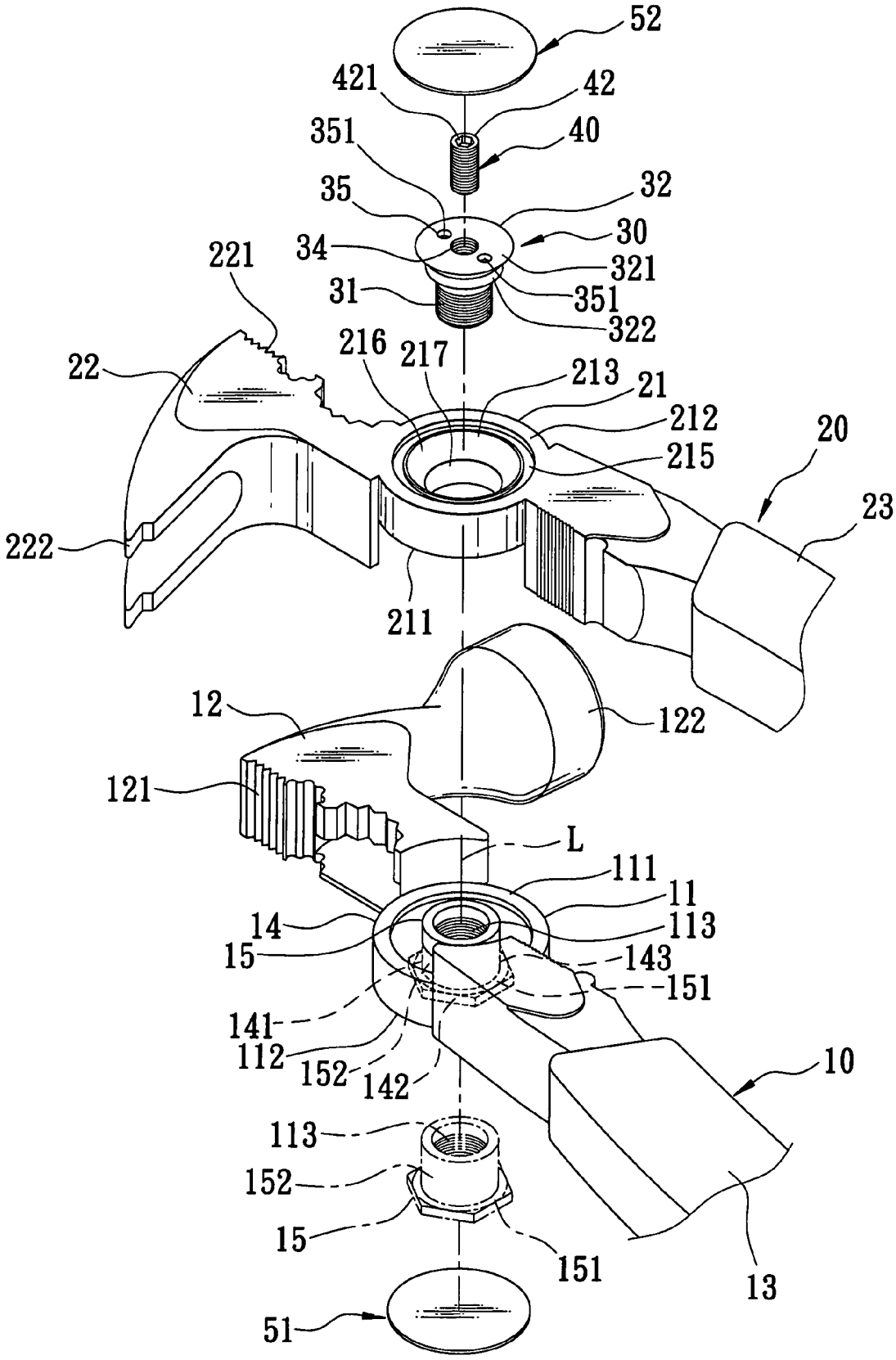
FIG. 1 is an exploded perspective view of the preferred embodiment of a pliers-type hand tool according to the present invention.
Figure 2:
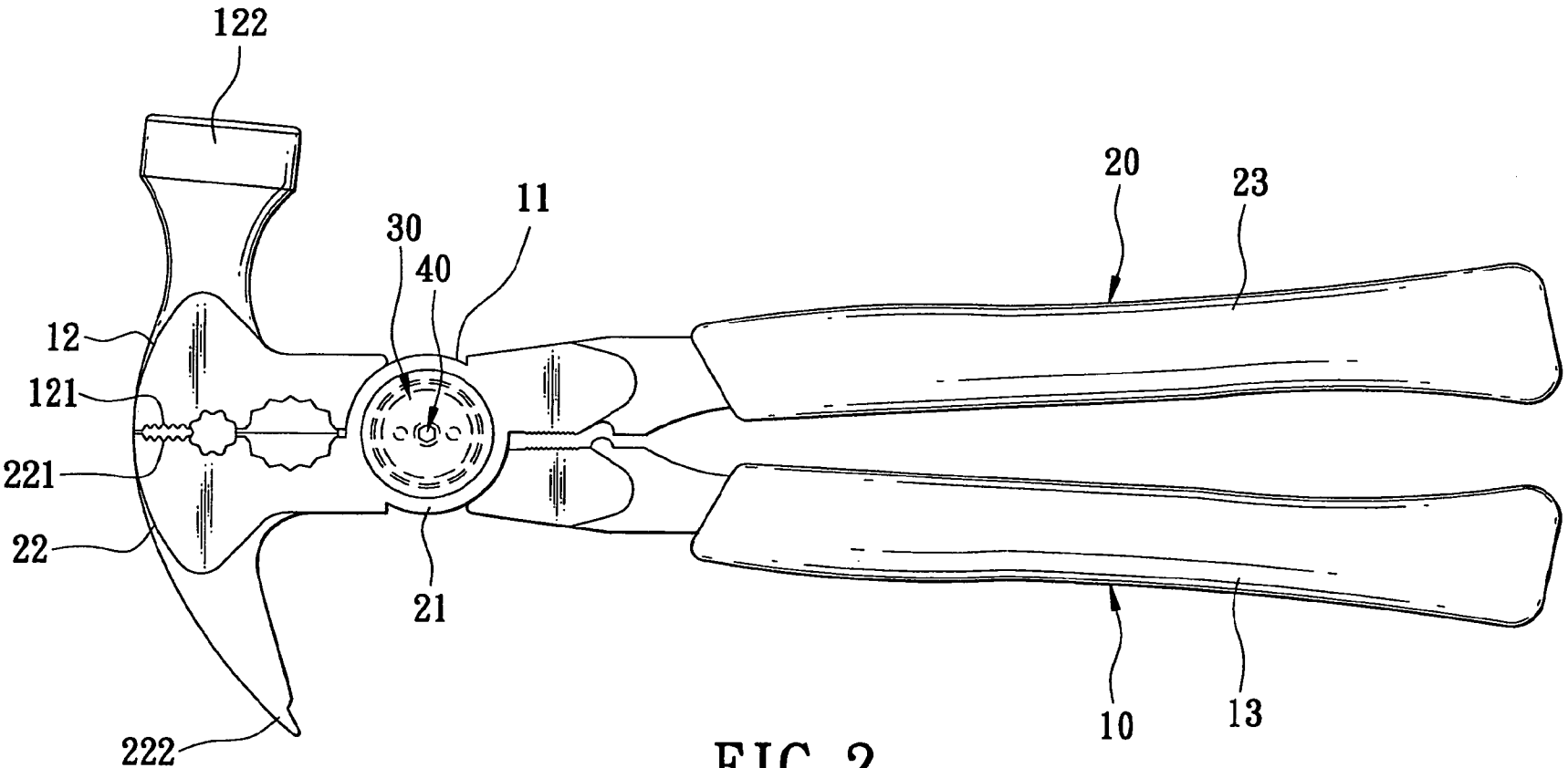
FIG. 2 is a schematic view of the preferred embodiment in an assembled state.
Figure 3:
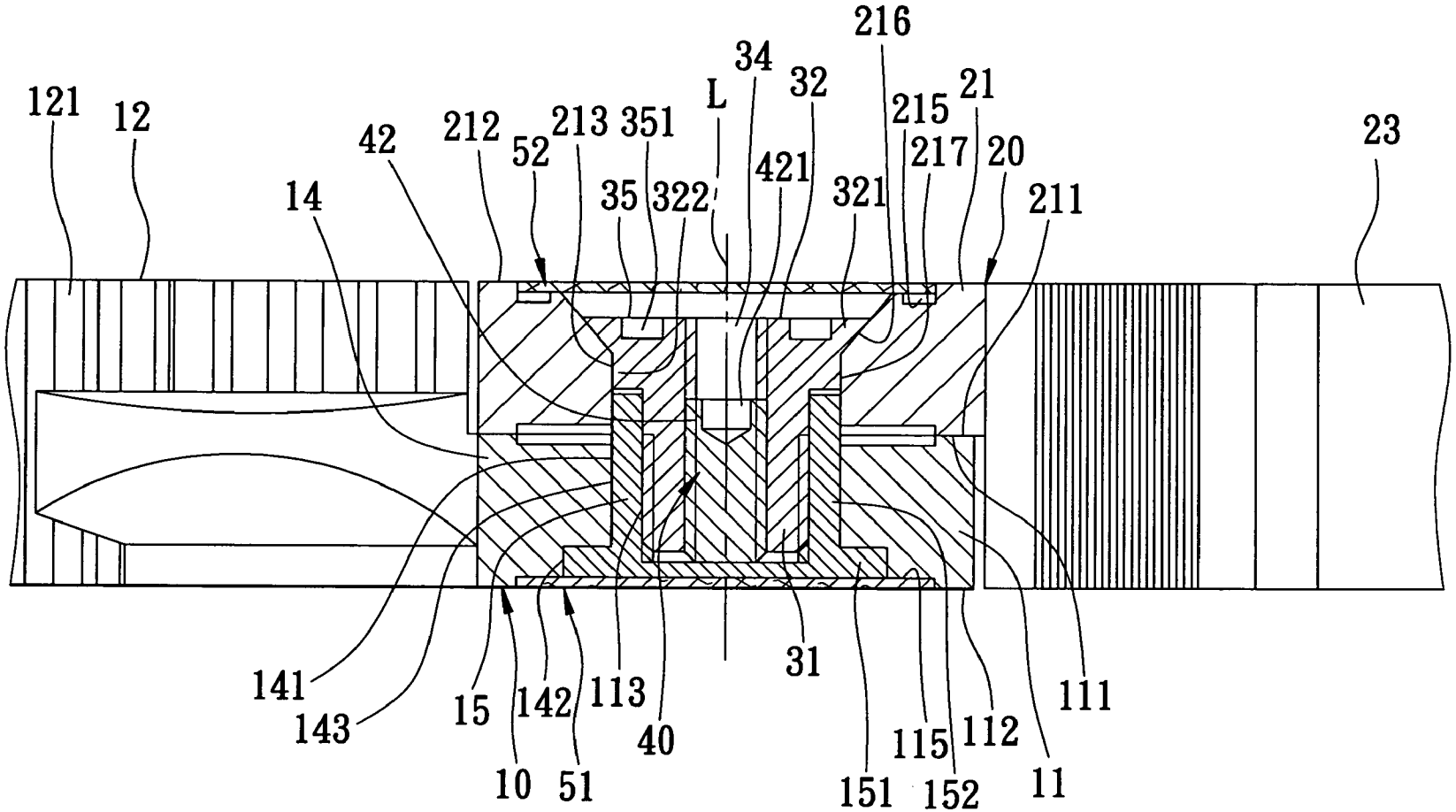
FIG. 3 is a fragmentary sectional view of the preferred embodiment shown in FIG. 2.

Referring to FIGS. 1 to 3, the preferred embodiment of a pliers-type hand tool according to this invention is shown to include first and second arms 10, 20, a pivot joint 30, and a locking member 40.

Each of the first and second arms 10, 20 includes a handle 13, 23, a jaw 12, 22, and an intermediate portion 11, 21 that interconnects the handle 13, 23 and the jaw 12, 22 thereof.

The pivot joint 30 interconnects the intermediate portions 11, 21 of the first and second arms 10, 20, and permits relative rotation of the first and second arms 10, 20 about a pivot axis (L) in a manner that will be described hereinafter.

The intermediate portion 11 of the first arm 10 includes fixed and removable members 14, 15. The fixed member 14 of the intermediate portion 11 of the first arm 10 is formed with a counter hole 141 that extends along the pivot axis (L). In particular, the fixed member 14 has first and second surfaces 111, 112 that are opposite to each other along the pivot axis (L). The counter hole 141 in the fixed member 14 has a head segment 142 that extends from the second surface 112 of the fixed member 14 and that has a non-circular shape, preferably hexagonal, along a first plane transverse to the pivot axis (L), and a tail segment 143 that extends from the head segment 142 to the first surface 111 of the fixed member 14 and that has a cylindrical shape. The removable member 15 includes head and shank portions 151, 152 that cooperatively define a threaded blind hole 113. In particular, the head portion 151 of the removable member 15 has a non-circular cross section, preferably hexagonal, along the first plane, and is disposed fittingly in the head segment 142 of the counter hole 141 in the fixed member 14. The shank portion 152 of the removable member 15 has a tubular shape, is formed with an inner thread, and extends along the pivot axis (L) from the head portion 151 of the removable member 15 and through the tail segment 143 of the counter hole 141 in the fixed member 14.

It is noted that since the fixed and removable members 14, 15 of the intermediate portion 11 of the first arm 10 are separate elements, the pliers-type hand tool of this invention is relatively easy to manufacture.

In an alternative embodiment, the fixed and removable members 14, 15 are formed integrally in one piece.

The intermediate portion 21 of the second arm 20 is formed with a through-hole 213 that extends along the pivot axis (L) and that has a funnel shape. In particular, the intermediate portion 21 of the second arm 20 has first and second surfaces 211, 212 that are opposite to each other along the pivot axis (L). The through-hole 213 in the intermediate portion 21 of the second arm 20 has a first segment 216 that extends from the second surface 212 of the intermediate portion 21 of the second arm 20 and that has a trapezoidal shape along a second plane parallel to the pivot axis (L), and a second segment 217 that extends from the first segment 216 to the first surface 211 of the intermediate portion 21 of the second arm 20 and that has a cylindrical shape.

The pivot joint 30 includes head and shank portions 32, 31. The head portion 32 of the pivot joint 30 has a first end 321 that has a trapezoidal cross section along the second plane and that is disposed fittingly in the first segment 216 of the through-hole 213 in the intermediate portion 21 of the second arm 20, and a second end 322 that has a cylindrical shape and that is disposed fittingly in the second segment 217 of the through-hole 213 in the intermediate portion 21 of the second arm 20.

It is noted that the shank portion 152 of the removable member 15 of the intermediate portion 11 of the first arm 10 extends into the second segment 217 of the through-hole 213 in the intermediate portion 21 of the second arm 20.

The shank portion 31 of the pivot joint 30 extends along the pivot axis (L) from the second end 322 of the head portion 32 of the pivot joint 30 and through the first segment 216 of the through-hole 213 in the intermediate portion 21 of the second arm 20, and threadedly engages the threaded blind hole 113 in the removable member 15 of the intermediate portion 11 of the first arm 10.

In this embodiment, the pivot joint 30 is provided with an operable member 35 that is operable with a tool (not shown) so as to drive the pivot joint 30 into the threaded blind hole 113. In this embodiment, the operable member 35 includes diametrically opposite grooves 351 that are formed in a top surface of the first end 321 of the head portion 32.

The locking member 40 serves to tighten engagement between the shank portion 31 of the pivot joint 30 and the threaded blind hole 113. In particular, the pivot joint 30 is formed with a threaded through-hole 34 that extends along the pivot axis (L) and through the head and shank portions 32, 31 thereof. The locking member 40 threadedly engages and extends through the threaded through-hole 34 in the pivot joint 30, and abuts against the head portion 151 of the removable member 15 of the intermediate portion 11 of the first arm 10.

In this embodiment, the locking member 40 is formed with a hexagonal slot 421 that is operable with an Allen key (not shown) so as to drive the locking member 40 into the threaded through-hole 34 in the pivot joint 30. Moreover, the locking member 40 has a length shorter than that of the threaded through-hole 34 in the pivot joint 30.

The pliers-type hand tool further includes first and second adhesive coverings 51, 52, each of which serves to cover the head portion 151, 32 of a respective one of the removable member 15 and the pivot joint 30. In particular, the second surface 112 of the fixed member 14 of the intermediate portion 11 of the first arm 10 is formed with a first recess 115 that has a diameter larger than that of the counter hole 141 in the fixed member 14. The first adhesive covering 51 is disposed in the first recess 115 and is attached adhesively to the fixed member 14 of the intermediate portion 11 of the first arm 10. Further, the second surface 212 of the intermediate portion 21 of the second arm 20 is formed with a second recess 215 that has a diameter larger than that of the through-hole 213 in the intermediate portion 21 of the second arm 20. The second adhesive covering 52 is disposed in the second recess 215 and is attached adhesively to the intermediate portion 21 of the second arm 20.

The jaw 12, 22 of each of the first and second arms 10, 20 has a toothed side 121, 221, and a side that is opposite to the toothed side 121, 221 and that is formed with a respective one of a hammerhead 122 and pair of claws 222.

During assembly, the intermediate portion 21 of the second arm 20 is first placed on top of the intermediate portion 11 of the first arm 10 such that the shank portion 152 of the removable member 15 of the intermediate portion 11 of the first arm 10 extends into the second segment 217 of the through-hole 213 in the intermediate portion 21 of the second arm 20. Then, the pivot joint 30 is inserted into the through-hole 213 in the intermediate portion 21 of the second arm 20, is threadedly engaged to the threaded blind hole 113 in the removable member 15 of the intermediate portion 11 of the first arm 10, and is driven until a desired tightness is achieved. Thereafter, the locking member 40 is inserted into and is threadedly engaged to the threaded through-hole 34 in the pivot joint 30, and is driven until the locking member 40 extends through the threaded through-hole 34 and abuts against the head portion 151 of the removable member 15 of the intermediate portion 11 of the first arm 10.

From the above description, the pliers-type hand tool of this invention has the following advantages:

1. The pivot joint 30 may be driven to an appropriate tightness to ensure smooth operation of the pliers-type hand tool of this invention.

2. The intermediate portions 11, 21 the first and second arms 10, 20 do not need to be smoothened after assembly.

3. When the pivot joint 30 becomes loose after a certain period of use of the pliers-type hand tool of this invention, the pivot joint 30 may be simply re-tightened through manipulation of the pivot joint 30 and the locking member 40.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pliers-type hand tool, comprising:

a first arm including a handle, a jaw, and an intermediate portion that interconnects said handle and said jaw thereof and that is formed with a threaded blind hole;

a second arm including a handle, a jaw, and an intermediate portion that interconnects said handle and said jaw thereof and that is formed with a through-hole;

a pivot joint interconnecting said intermediate portions of said first and second arms, and permitting relative rotation of said first and second arms about a pivot axis, said pivot joint including a head portion, and a shank portion that extends along the pivot axis from said head portion and through said through-hole in said intermediate portion of said second arm, and that threadedly engages said threaded blind hole in said intermediate portion of said first arm, said pivot joint being formed with a threaded through-hole that extends along the pivot axis and through said head and shank portions thereof; and a locking member for tightening engagement between said shank portion of said pivot joint and said threaded blind hole, said locking member threadedly engaging and extending through said threaded through-hole in said pivot joint, and abutting against said intermediate portion of said first arm.

2. The pliers-type hand tool as claimed in claim 1, wherein said intermediate portion of said first arm includes a fixed member that is formed with a counter hole extending along the pivot axis, said counter hole in said fixed member having a head segment that has a non-circular shape along a plane transverse to the pivot axis, and a tail segment that has a cylindrical shape, and a removable member that includes head and shank portions cooperatively defining said threaded blind hole, said head portion of said removable member having a non-circular cross section along the plane and being disposed fittingly in said head segment of said counter hole in said fixed member, said shank portion having a tubular shape, being formed with an inner thread, and extending along the pivot axis from said head portion of said removable member, through said tail segment of said counter hole in said fixed member, and into said through-hole in said intermediate portion of said second arm.

3. The pliers-type hand tool as claimed in claim 1, wherein said through-hole in said intermediate portion of said second arm has a funnel shape, and has first and second segments, said head portion of said pivot joint has a first end that has a trapezoidal cross section along a plane parallel to the pivot axis and that is disposed fittingly in said first segment of said through-hole in said intermediate portion of said second arm, and a second end that has a cylindrical shape and that is disposed fittingly in said second segment of said through-hole in said intermediate portion of said second arm, said shank portion of said pivot joint extending from said second end of said head portion of said pivot joint.

4. The pliers-type hand tool as claimed in claim 1, wherein said pivot joint is provided with an operable member that is operable so as to drive said pivot joint into said threaded blind hole.

5. The pliers-type hand tool as claimed in claim 4, wherein said operable member includes diametrically opposite grooves formed in said head portion of said pivot joint.

6. The pliers-type hand tool as claimed in claim 1, wherein said intermediate portion of said second arm is formed with a recess that has a diameter larger than that of said through-hole in said intermediate portion of said second arm, said pliers-type hand tool further comprising an adhesive covering disposed in said recess and attached adhesively to said intermediate portion of said second arm, thereby covering said head portion of said pivot joint.

7. The pliers-type hand tool as claimed in claim 2, wherein said intermediate portion of said first arm is formed with a recess that has a diameter larger than that of said counter hole in said fixed member, said pliers-type hand tool further comprising an adhesive covering disposed in said recess and attached adhesively to said intermediate portion of said first arm, thereby covering said head portion of said removable member.

8. The pliers-type hand tool as claimed in claim 1, wherein said jaw of said first arm is formed with a hammerhead.

9. The pliers-type hand tool as claimed in claim 1, wherein said jaw of said second arm is formed with a pair of claws.

* * * * *